US008857642B2

(12) United States Patent
Liebowitz et al.

(10) Patent No.: US 8,857,642 B2
(45) Date of Patent: Oct. 14, 2014

(54) LIGHTWEIGHT FRUIT AND PRODUCE PACKAGING CONTAINER

(75) Inventors: Michael Liebowitz, Concord, CA (US); Jay Thomas, Folsom, CA (US); Trevor Ferruggia, Elk Grove, CA (US)

(73) Assignee: Pandol Bros., Inc., Delano, CA (US)

( * ) Notice: Subject to any disclaimer, the term of this patent is extended or adjusted under 35 U.S.C. 154(b) by 0 days.

(21) Appl. No.: 13/102,009

(22) Filed: May 5, 2011

(65) Prior Publication Data

US 2011/0290809 A1 Dec. 1, 2011

Related U.S. Application Data

(60) Provisional application No. 61/331,386, filed on May 5, 2010, provisional application No. 61/375,878, filed on Aug. 23, 2010.

(51) Int. Cl.

| | |
|---|---|
| ***B65D 5/42*** | (2006.01) |
| ***B65D 5/02*** | (2006.01) |
| ***B65D 5/46*** | (2006.01) |
| ***B65D 5/36*** | (2006.01) |

(52) U.S. Cl.

CPC ..... *B65D 5/4295* (2013.01); *B65D 2301/20* (2013.01); *B65D 5/029* (2013.01); *B65D 5/46072* (2013.01); *B65D 5/02* (2013.01); *B65D 5/3621* (2013.01)

USPC ..... 220/62; 220/6; 29/117.01; 29/117.22

(58) Field of Classification Search

CPC ..... B65D 5/4612; B65D 5/46152; B65D 5/46088; B65D 5/46072; B65D 25/2894; B65D 25/2897

USPC ..... 220/62, 761, 771, 745, 676, 601; 229/117.22, 117.23, 117.13, 117.12, 229/117.01, 931, 117.3, 119; 493/162, 63

See application file for complete search history.

(56) References Cited

U.S. PATENT DOCUMENTS

| | | | | | |
|---|---|---|---|---|---|
| 1,558,155 | A * | 10/1925 | Flansburg | 229/122.28 |
| 1,576,672 | A * | 3/1926 | Miller | 229/107 |
| 1,668,800 | A * | 5/1928 | Bonfield | 229/117.14 |
| 1,828,448 | A * | 10/1931 | Seidel | 47/73 |
| 2,033,285 | A * | 3/1936 | Harvey | 4/290 |
| 2,260,230 | A * | 10/1941 | Olson | 229/119 |
| 2,693,310 | A * | 11/1954 | Stopper | 229/117.15 |
| 2,785,846 | A * | 3/1957 | Morris | 229/117.15 |
| 3,194,480 | A * | 7/1965 | Maindron | 229/117.15 |
| 3,750,933 | A * | 8/1973 | Nicolay | 229/240 |
| 3,817,371 | A * | 6/1974 | Gatter | 206/0.5 |
| 4,126,265 | A * | 11/1978 | Holmes | 206/509 |
| 4,134,534 | A * | 1/1979 | Scott et al. | 229/117.15 |
| 4,195,765 | A * | 4/1980 | Roccaforte et al. | 229/117.15 |
| 4,392,607 | A * | 7/1983 | Perkins, Jr. | 229/109 |
| D284,552 | S * | 7/1986 | Weaver | D9/433 |
| 6,378,733 | B1 * | 4/2002 | Boonzaier | 222/105 |
| 7,323,312 | B2 * | 1/2008 | Yoshiki et al. | 435/7.1 |
| 7,623,312 | B2 * | 11/2009 | Ehrlich | 360/71 |
| 2004/0089672 | A1 * | 5/2004 | Crosland et al. | 222/105 |

* cited by examiner

*Primary Examiner* — Robert J Hicks

(74) *Attorney, Agent, or Firm* — Michael K. Bosworth; Claude A. S. Hamrick; IPxLaw Group LLP

(57) ABSTRACT

A lightweight fruit and produce packaging container made from a die cut blank of thin, flexible, waterproof, food quality, transparent sheet material and including a plurality of fold lines defining wall portions, top and bottom closure portions, a latching portion and a handle forming portion.

13 Claims, 14 Drawing Sheets

FIG. 13
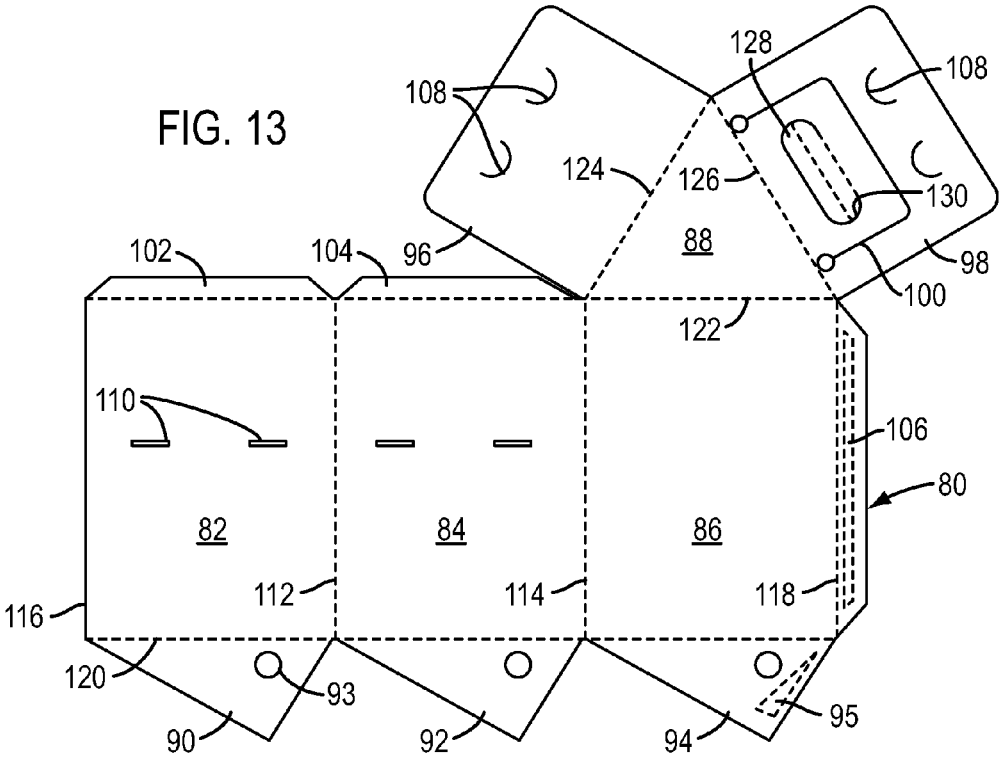
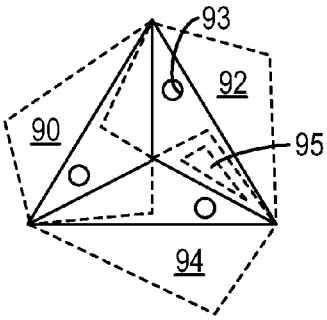
FIG. 14
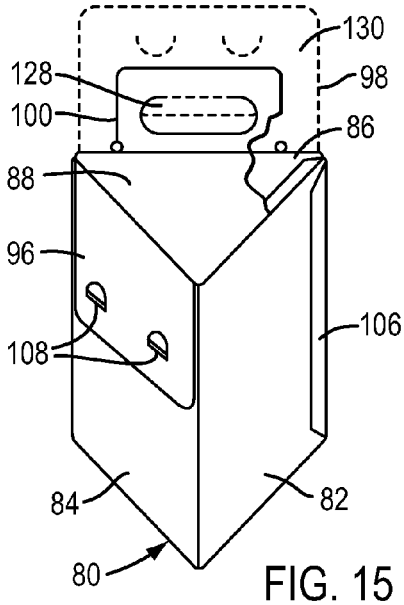
FIG. 15

LIGHTWEIGHT FRUIT AND PRODUCE PACKAGING CONTAINER

RELATED APPLICATIONS

This application is related to and claims priority to U.S. Provisional Application Ser. No. 61/331,386 filed May 5, 2010 entitled LIGHTWEIGHT FRUIT AND PRODUCE PACKAGING CONTAINER, and U.S. Provisional Application Ser. No. 61/375,878 filed Aug. 23, 2010 entitled LIGHTWEIGHT FRUIT AND PRODUCE PACKAGING CONTAINER, both of which are incorporated hereinto in their entireties.

FIELD OF THE INVENTION

The present invention relates generally to Fruit and Produce containers, and more specifically to a novel packaging container made by die cutting a predefined blank from a sheet of flexible work material, folding certain portions of the blank along predefined fold lines, and fastening the folded portions together to define a container having apertures in the top, bottom and side walls thereof and an integrally formed handle for facilitating handling of the container. Such container being particularly suited for use in various applications wherein the contents are to be washed, stored, shipped, displayed and/or handled by consumers.

BACKGROUND OF THE INVENTION

Numerous types of containers are known and used for packaging various types of fruits and produce, as well as other goods, in both large and small quantities. Such containers have many configurations, features and advantages that favor their use in particular applications. Although anticipated to have utility in many diverse applications, the present invention is primarily directed to the provision of packaging for relatively small quantities of fruits, berries and produce as well as other items that may require special treatment during containment.

For example, table grapes are usually marketed attached to their vine stems and separated into bunches which may or may not be packaged. In either case, the bunches should ideally be rinsed with water to remove dust, dirt, bug and bird residue, as well as other potential contaminants that may originally reside on, or take up residence on the surfaces of the fruit during the time between picking and presentation to the consumer in a market. Moreover, the grapes must be cooled to discourage mold growth and untimely spoilage.

Other factors that must be considered relative to the segregation and packaging of the aforementioned types of products into suitable quantities include provision for reasonable consumer inspection of the packaged product, protection of the product against damage during stocking and consumer handling, ease of handling of the packaged product, and stack ability of the packages into larger containers, boxes, trays or on shelves which accommodate cooling, shipping, storage and display.

A wide variety of different types of containers are presently used in the relevant market and include wooden, plastic and cardboard baskets; buckets of various sizes, both with and without lids or other closures; "clam shell" boxes made of plastic, Styrofoam or paperboard; blister packs, etc. Many these types of containers are made from blanks die cut from sheet stock of one type or another and folded to form an open or closable basket. An example of such container is disclosed in the U.S. patent to Holmes, U.S. Pat. No. 4,126,265, wherein a die cut blank made of corrugated cardboard is folded along a plurality of fold lines, and extremities thereof are fastened together to form an open produce basket.

Another example of a container made by folding a die cut blank and used for storing and shipping fruits and other perishables is disclosed in Mittlestaedt et al, U.S. Pat. No. 7,628,312. The container disclosed in this patent is distinguished in one aspect from the Holmes container in that it also includes a closure component.

However, these containers as well as the previously mentioned plastic containers fail to address the problems of providing adequate product ventilation, drain ability of washing fluids or condensation, simplicity of assembly, low cost, shipping economy due to the use of collapsible and extremely light materials, and/or product visibility through the walls of the container.

It is therefore an objective of the present invention to provide an improved lightweight, relatively inexpensive and easily fabricated container suitably configured for use in the marketing of relatively small quantities of fruit and produce, and the like.

Another objective of the present invention to provide a container made from die cut blank that is folded along a plurality of predetermined fold lines defining wall segments and closures which are interlocked and/or fastened together to form an improved enclosure of the type described.

Still another objective of the present invention is to provide a container of the type described adapted to allow contained items to be washed and cooled in situ without having to open the container, A further objective of the present invention to provide a container of the type described having an integrated handle for facilitating handling and carriage of the packaged goods.

Still another objective of the present invention to provide a container of the type described that is collapsible after fabrication so as to take up minimal space and thus reduce the cost of storage and shipping from manufacturer to packager.

SUMMARY OF INVENTION

Briefly, a presently preferred embodiment of a packaging container in accordance with the present invention is made from a die cut blank of thin, flexible, waterproof, food quality, transparent sheet material including a plurality of fold lines defining wall portions, top and bottom closure portions, a latching portion and a handle forming portion.

More specifically, the packaging container is made by folding an elongated wall forming portion of the blank along a first plurality of fold lines to form four contiguous container walls, and folding a plurality of closure forming portions extending from the elongated portion about a second plurality of fold lines to define a predetermined volume of space, and by further folding at least one other portion about a third fold line to form a fastening flap having means for securing at least one of the closure forming portions to at least one of the wall forming portions. The flap may also include a sub-portion thereof extending from the third fold line to form a carry handle for the container.

In an alternative embodiment, the elongated wall forming portion of the blank includes only three wall forming segments foldable along a first plurality of fold lines and having closure forming segments extending therefrom which are foldable about a second plurality of fold lines to define a containing volume of space. The blank further includes at least one other segment extending from a closure segment and which is foldable about a corresponding third fold line to form a fastening flap having means for securing the closure forming segment to at least one of the wall forming segments, the flap having a sub-segment thereof extending from and foldable along the third fold line to form a carry handle for the container.

Another alternative embodiment is made from a blank having an elongated wall forming portion that also includes three contiguous segments foldable along a first plurality of fold lines, and having interlocking closure forming segments extending from the elongated portion and foldable about a second plurality of fold lines to cooperate with the wall forming segments to define a containing volume of space. The blank further includes at least one other segment extending from a wall forming segment and foldable about a corresponding third fold line to form a fastening flap having means for securing the closure forming segment to at least one of the other wall forming segments, the flap having a sub-segment thereof extending from and foldable along the third fold line to form a carry handle for the container.

An important objective of the present invention to provide a container of the type described it is made from a single die cut blank having segments folded and held together with a combination of integral interlocking and/or simple glue strip fastenings.

Another advantage is that the blank is provided with a plurality of openings in the wall and closure forming portions/segments which facilitate in situ washing, cooling and drying of the contained product.

Still another advantage of the present invention is that it is made from a sheet of transparent or translucent plastic and therefore provides good visibility of the packaged product.

Yet another advantage of the present invention is that the container is configured in regular geometric shapes and thus can be conveniently and compactly placed with other like units in larger shipping containers, and on display shelves or racks with no loss of space therebetween.

A further advantage of the present invention is that the container includes an integral handle that makes it easy to handle and carry, as well as suspend beneath a faucet to flood and rinse the contained produce.

A still further advantage of the present invention is that it provides a container of the type described that is collapsible after fabrication so that it can be stored and shipped in compact form.

These and other objects and advantages of the present invention will become apparent to those skilled in the art following a reading of the description herein which makes reference to the several figures of drawing.

IN THE DRAWING

FIGS. 13-15 illustrate a first alternative embodiment of a container in accordance with the present invention;

Figure 18:
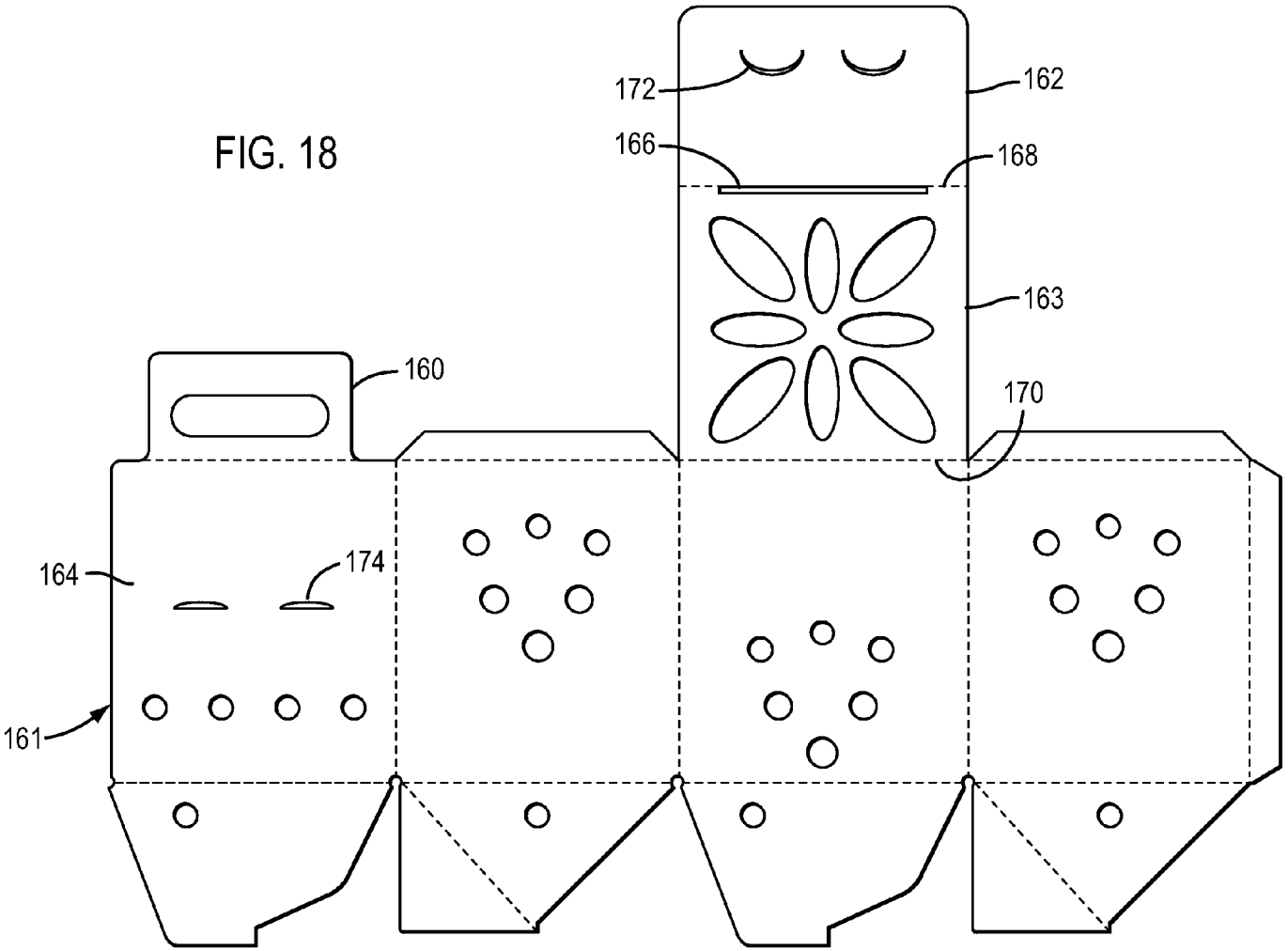
Figure 20:
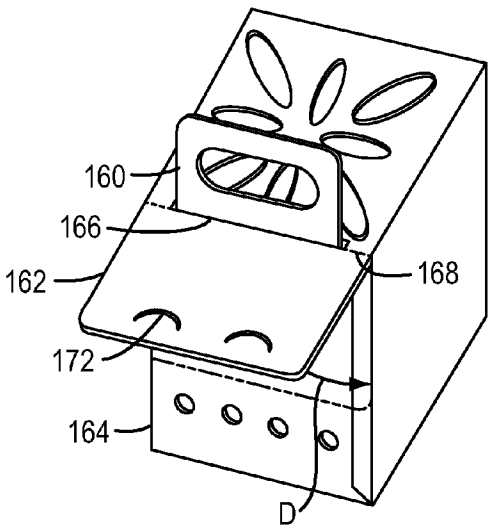
Figure 19:
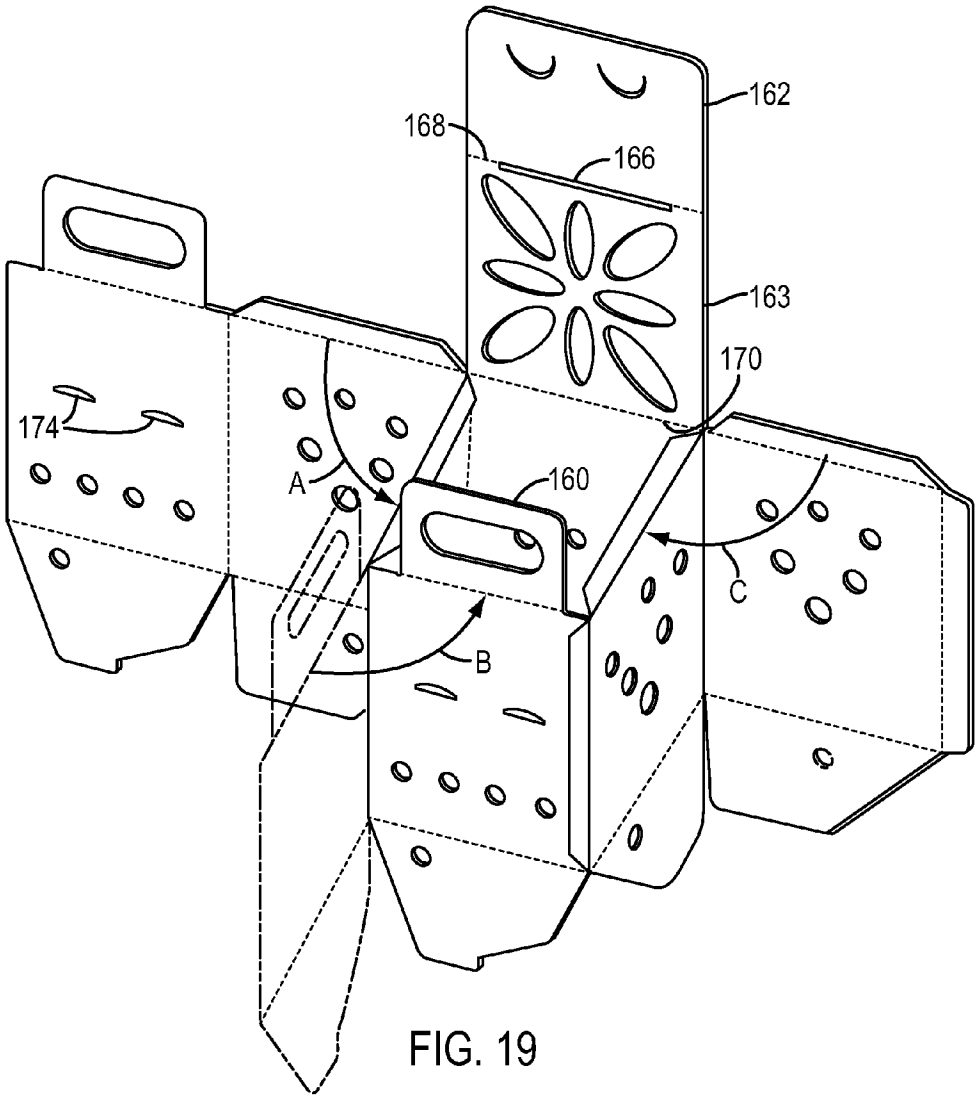

FIGS. 18-20 illustrate a third alternative embodiment of a container in accordance with the present invention in which the handle forming portion of the blank is an extended segment of a wall forming portion and extends through a slot formed in the top forming closure portion; and FIGS. 21-25 illustrate a fourth alternative embodiment of a container in accordance with the present invention in which multiple latch forming portions are provided.

DESCRIPTION OF THE EMBODIMENTS

Figure 1:
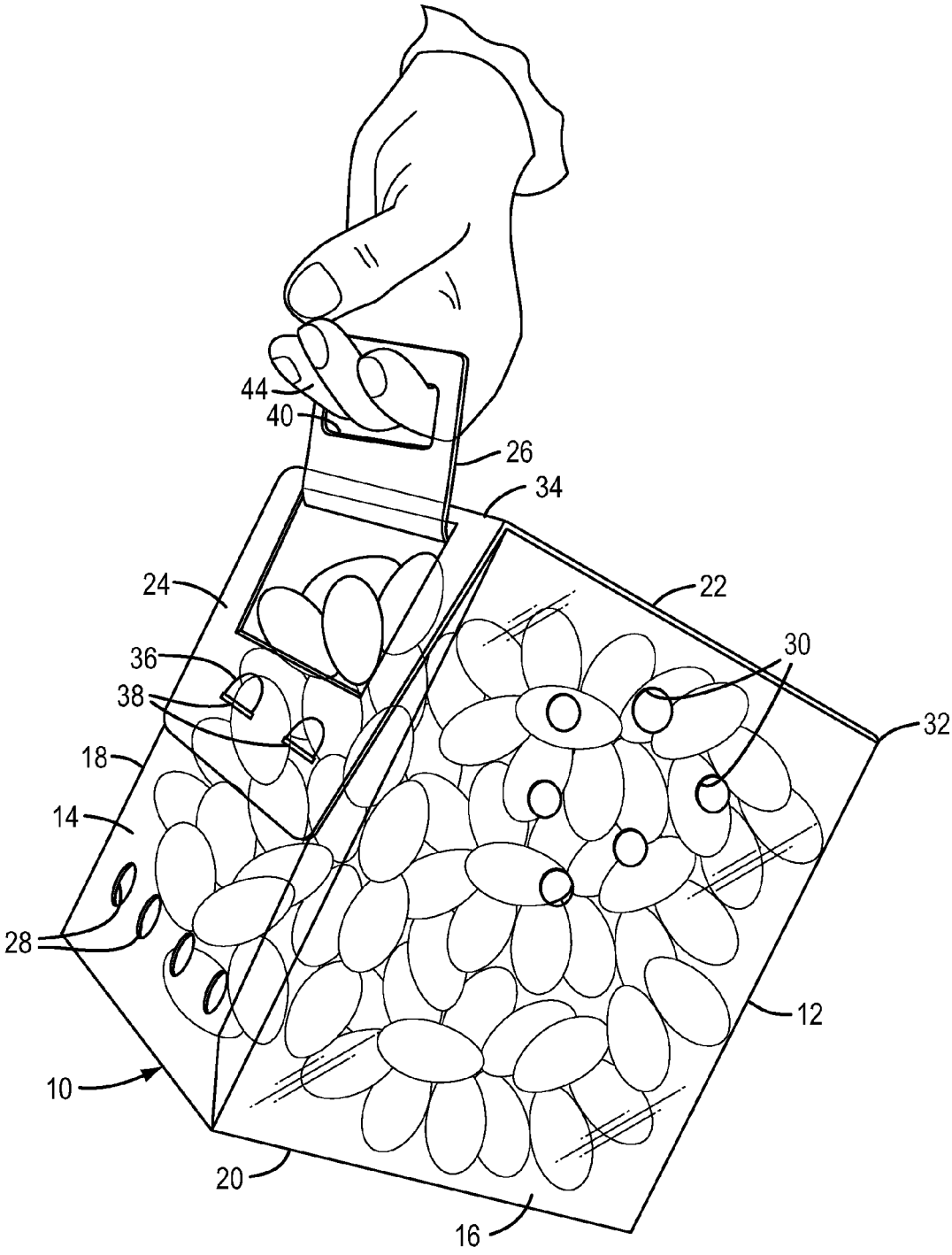
FIG. 1 is a perspective view illustrating a packaging container in accordance with a presently preferred embodiment of the present invention.

Referring to FIG. 1 of the drawing, a presently preferred embodiment of a fruit or produce packaging container in accordance with the present invention is illustrated at 10 and includes a front wall panel 12, a rear wall panel 14, two side wall panels 16 and 18, a multi-segmented bottom 20 (not shown), a top closure 22, a latch flap 24 and a handle 26 which is shown folded up out of the plane of flap 24. As will be further explained below, each of the panels 12-18 includes a plurality of oval shaped openings 28, used to provide ventilation to the interior of the container 10. As will also be illustrated below, top closure 22 and the bottom closure segments are also apertured to permit passage of a washing liquid such as water there through.

As will also be further explained below, the top closure 22 is hinged at a fold line 32 which extends along the upper edge of front panel 12, and the latch flap 24 and handle 26 are hinged at a fold line 34 which extends over and along the upper edge of the rear panel 14. Flap 24 also has a pair of upwardly extending half-moon shaped latch tabs 36 cut therein that are bent inwardly toward the container and extended through slits 38 formed in the rear panel 14 to lock the flap 24 and upper closure 22 in place.

Flap 26 is provided with a laterally extending finger slot 40 for receiving the fingers of a carrier as illustrated at 44.

It may also be understood that the container 10 is advantageously made of thin plastic sheet material that is transparent or translucent, and thus allows visual inspection of the contents, which in the illustrated case are table grapes.

Figure 2:
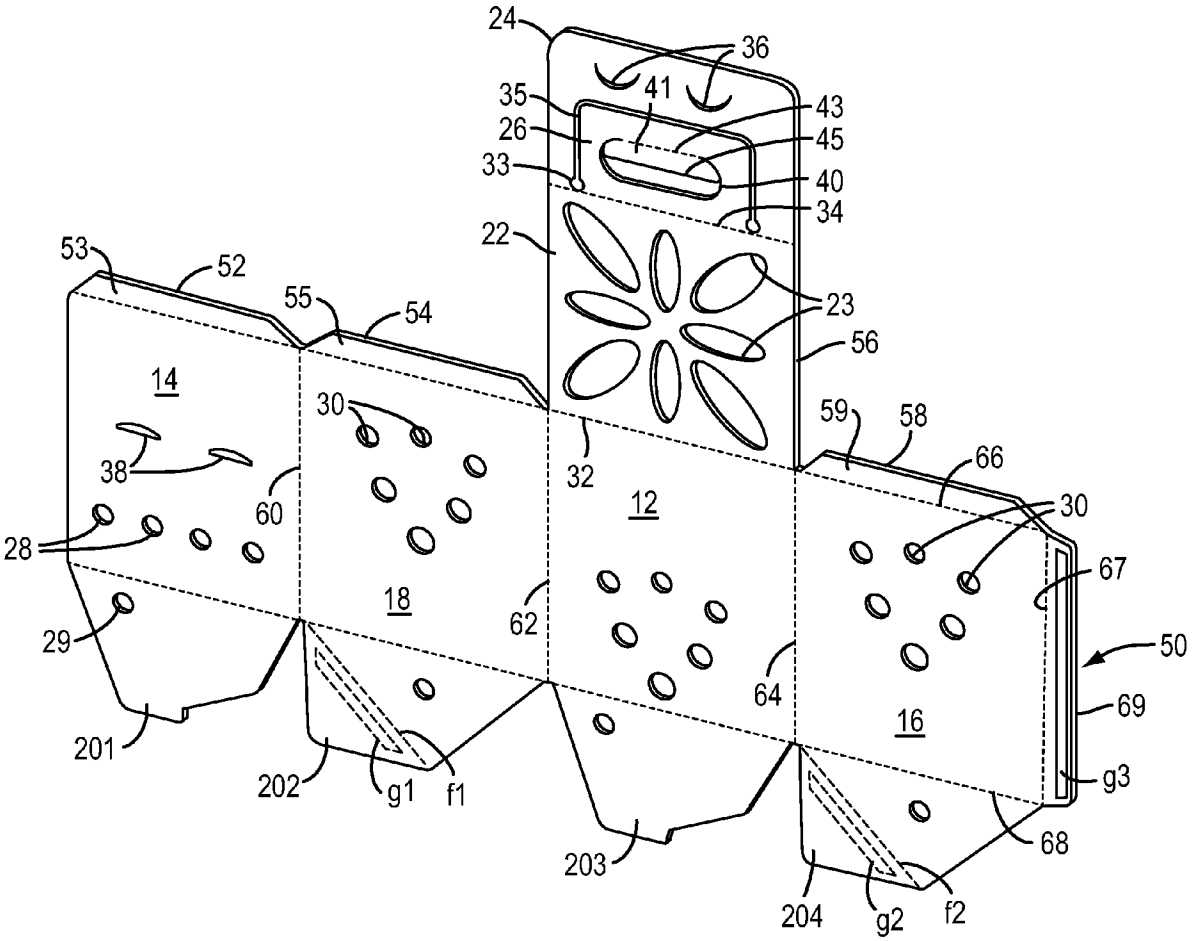
FIG. 2 is a perspective view showing a blank cut from sheet material and foldable about a plurality of fold lines to form the container of FIG. 1.

FIG. 2 is a perspective view showing a die cut blank 50 after it is cut from sheet plastic of any suitable thickness and opacity, such blank being used to form the container shown in FIG. 1. In the preferred embodiment the sheet stock from which the blank is cut is food grade clear PET (Polyethylene terephthalate) plastic of 0.014 inch thickness. As illustrated, the blank 50 includes an elongated portion which is subdivided into four major parts 52, 54, 56, and 58 by three vertically extending fold lines 60, 62 and 64. Each of the three parts 52, 54 and 58 are further subdivided by the fold lines 66, 67 and 68 to define the front wall forming panel 12, the rear wall forming panel 14, and the two side wall forming panels 16 and 18. Although the panels may be of any suitable dimensions, in this embodiment the panels are approximately 5½ inches tall and 4¾ inches wide.

The fold line 66 also defines edge stiffener tabs 53, 55 and 59 and serves as the hinge line for the upper closure panel 22, as well as defining the upper extremity of the front panel 12. The fold line 67 also defines a vertically extending fastening or glue tab 69 that is used to affix the right side edge of panel 16 to the left side edge of panel 14. To accomplish the fastening function, tab 69 may have printed thereon a strip g3 of contact or other adhesive intended to mate with a similar strip (not depicted) carried on the opposite side of an edge portion of front panel 14. Alternatively, the adhesive agent might be a strip of sticky mastic temporarily covered by a disposable wax paper strip or the like, or even be a strip or plurality of segments of heat or pressure activated glue.

The dashed line 68 also defines the upper extremities and fold line of the bottom closure segments 201, 202, 203 and 204. Note that the closure segments 201-204 all have at least one oval shaped aperture 29 strategically provided therein, and that the segments 201, 203 are shaped somewhat differently than the segments 202, 204 to facilitate interleaving, as well as allowing the assembled or fabricated container to be collapsed for compact shipping and storage. Note also that the facing edges of adjacent segments do not converge to points at their intersections but rather converge to opposite ends of short (approx. 0.20 inch) edge segments of the panel junctions so that when folded and interleaved to form the bottom closure, small openings are formed at each corner of the container. Thus the oval apertures 29, as well as the small openings at the corners provide good drainage passageways for the bottom of the container.

Also illustrated in this figure are the groups of oval shaped apertures 28 and 30 provided in the container walls 12-18 to provide good flow-through ventilation so that when the produce loaded container is placed in a cooled environment (especially when forced ventilation is employed) the temperature within the container drops quickly to enhance the storage/shelf life of the produce stored therein.

As alluded to above, a portion 32 of the fold line 66 also serves as a hinge line for the upper closure panel 22 which, as illustrated, is provided with a stylized array of oval shaped apertures 23 that allow washing water other liquid to flood the product contained within the container as well as assisting in the cooling operation mentioned above. Liquid entering the container through the apertures 23 will be quickly drained there from through the apertures 29 and the corner openings provided at the intersections of the segments 201-204 as described above. Providing these apertures allows the contents to be washed while still in the container, thus eliminating the step of having to remove the contents prior to washing and the associated possible damage to the contents during handling.

It can also be seen in this figure that relief holes 33 are provided at the intersections of the fold line 34 and the handle defining cut line 35 so as to prevent ripping of the plastic at the ends of the cut line when a loaded container is carried using the handle. It will also be evident from this figure, and be further described below, that if not removed during the die cutting operation, the elongated segment 41 of plastic material can be displaced from the finger hole 40 by rotation about the fold line 43, and may also be folded along the fold line 45 to broaden the finger contact surface and prevent the upper extremity of the finger hole from hurting the carrier's fingers.

For reasons that will become apparent below, it may be also be advantageous to add strips or spots of glue, contact adhesive or other suitable mastic at several places on the bottom closure forming segments 201-204 including, for example, the strips illustrated at g1 and g2. Not also the fold lines f1 and f2 that facilitate collapse of the interleaved segments when the container is collapsed about two of the four fold lines 60, 62, 64, 67 in a manner well understood in the collapsible container industry.

Turning now to FIGS. 3-11, steps involved in fabricating the container from the blank shown in FIG. 2 are illustrated. As suggested by the arrow A in FIG. 3, one might first fold the panels 14, 18 on the left side of the figure forward about the fold line 62; then fold the panel 14 about the fold line 60 as illustrated by the arrow B; then fold the panel 16 forward about the fold line 64 as illustrated by the arrow C; and finally, fold the vertically extending fastening tab 69 about the fold line 67 and press it into fastening engagement with the edge portion of panel 14. The fastening engagement as pointed out above may be accomplished using any of a number of fastening media or heat staking techniques. At this point, if not previously folded, the upper edge stiffening tabs 53, 55, 59 would be folded about their corresponding fold lines into either a horizontal disposition, or be folded flat against the inside walls of the associated side panels to stiffen or stabilize the upper edges of the wall panels. In some embodiments glue strips might be provided to seal the fully folded tabs in engagement with the upper portions of the associated panels.

Figure 3:
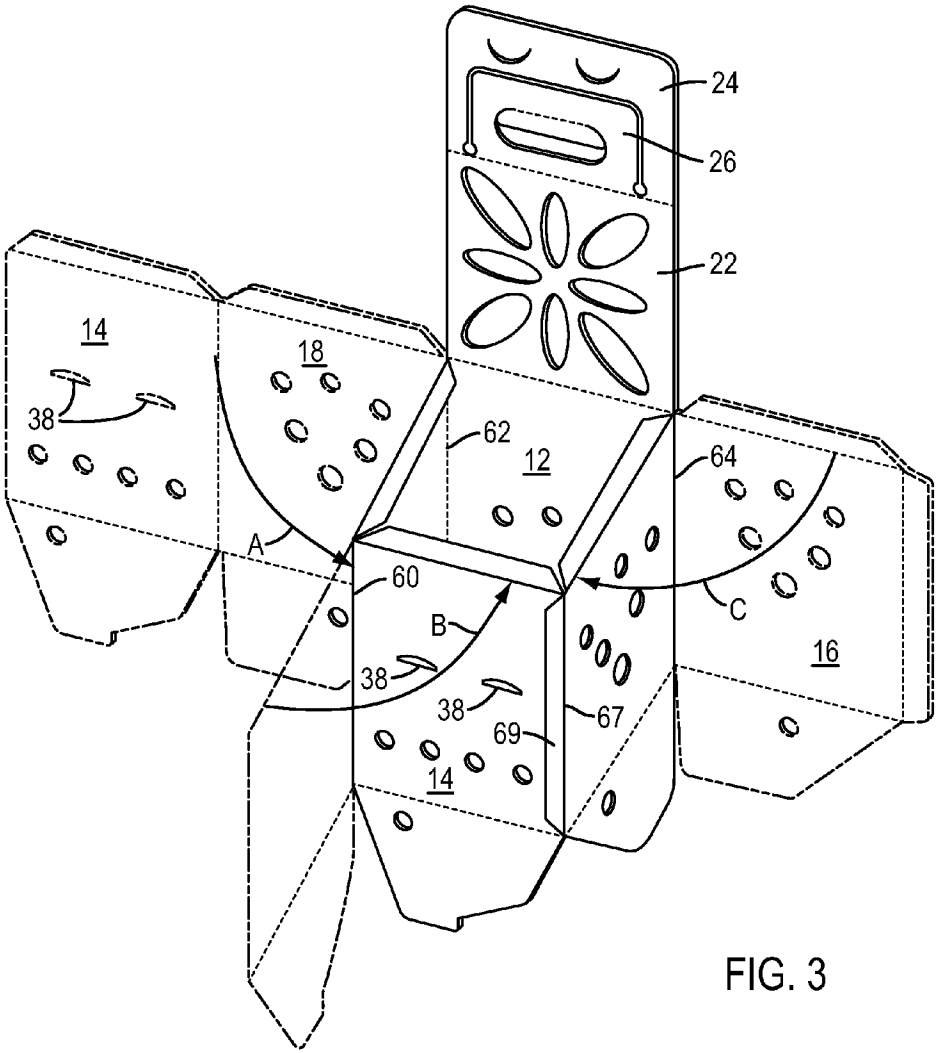
FIG. 3 is a perspective view illustrating the folding of a plurality of wall forming portions of the blank shown in FIG. 2 to form walls of the container illustrated in FIG. 1.
Figure 4:
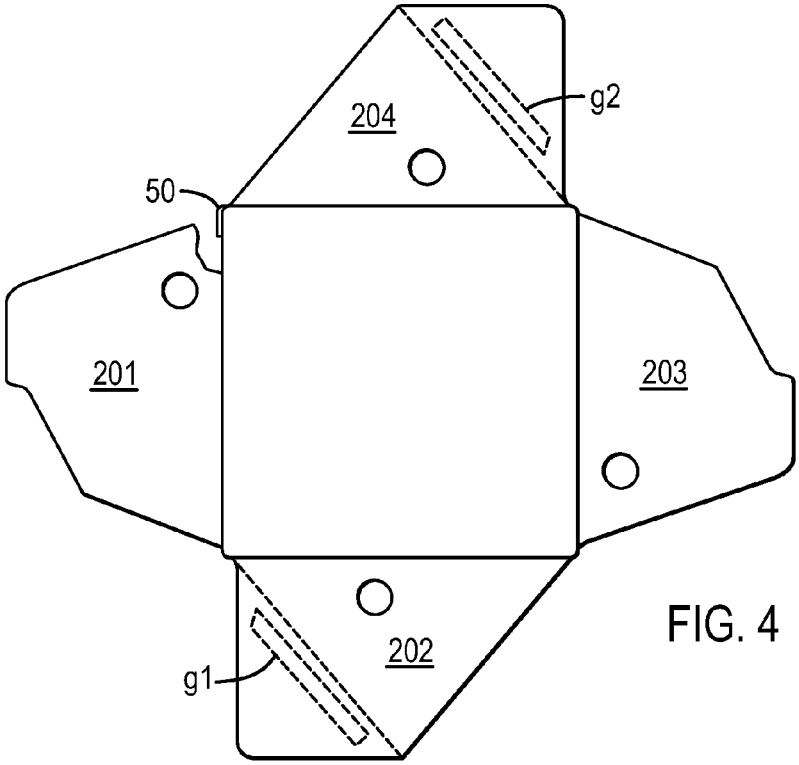
FIGS. 4-8 are a series of diagrams sequentially illustrating how the plurality of closure forming portions of the blank shown in FIG. 2 are folded about fold lines, interleaved and secured together to form a bottom closure for the container.
Figure 5:
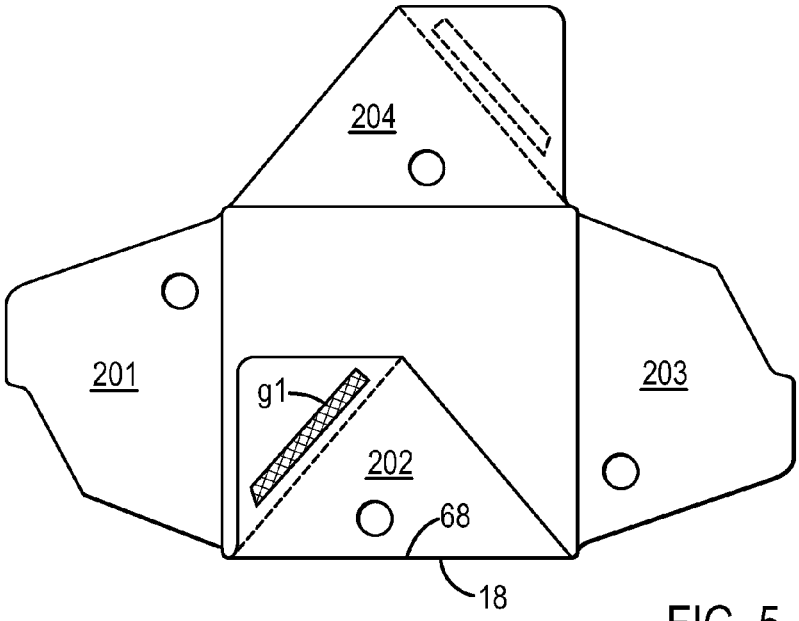

In FIGS. 4-7 the assembly of FIG. 3 is rolled so that the bottom faces the viewer, and for ease of identification, the bottom closure forming segments 201-204 are shown as initially flared outwardly, and the upper corner of segment 201 is broken away to show the position of the fastening flap 50. Note the glue strips g1 and g2 shown on segments 202 and 204 respectively. As a starting step illustrated in FIG. 5, one might first fold the segment 202 inwardly about fold line 68 (FIG. 2—the bottom edge of side panel 18) resulting in the surface carrying the glue strip 92 being turned to face the viewer.

Figure 6:
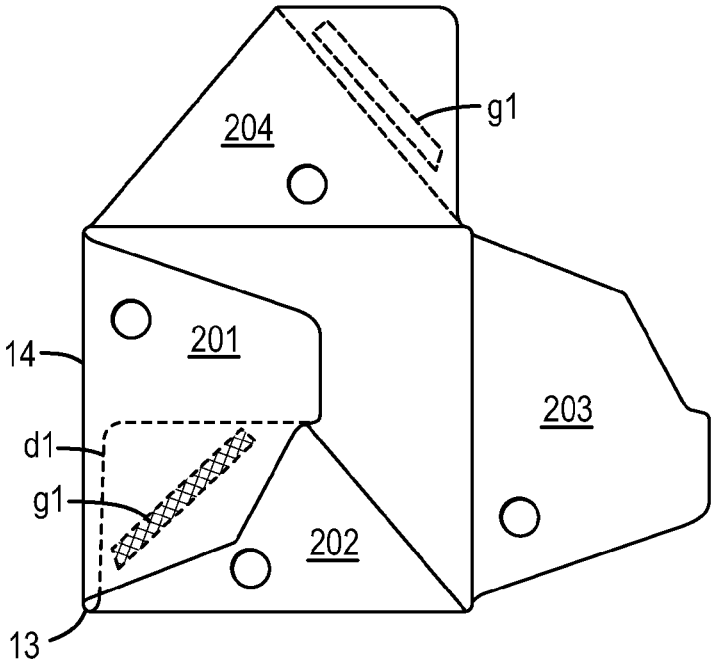

Segment 201 can then be rotated inwardly about the fold line 68 (at bottom of front panel 14), as depicted in FIG. 6, to overlie a portion d1 of segment 202 and engage and be adhered thereto by the glue strip g1. Note the small drainage opening 13 left at the corner where the segments do not overlap.

Figure 7:
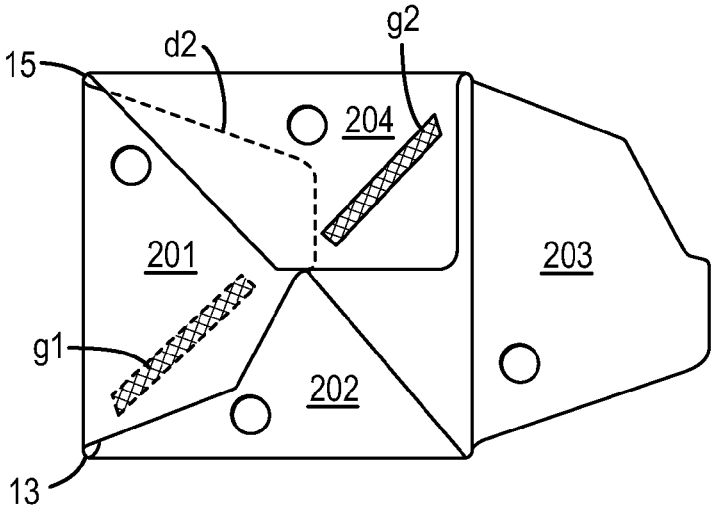

Next, as shown in FIG. 7, segment 204 can be folded to lie across the top of a portion of segment 201 as indicated by the dashed lines d2. Note the small drainage opening 15 left at the corner where the segments do not overlap.

Figure 8:
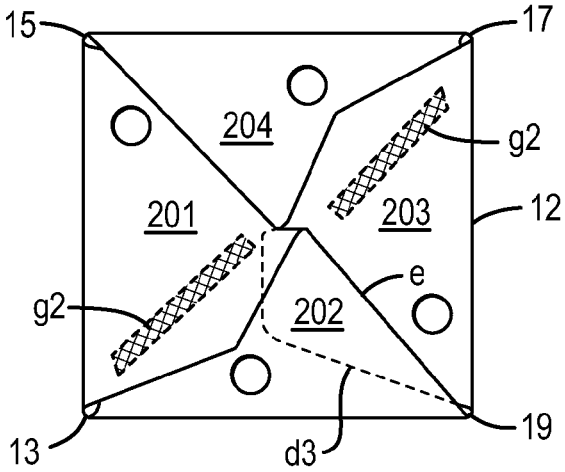

And finally, segment 203 can be rotated inwardly about the fold line 68 (at bottom of back panel 12), as depicted in FIG. 8, have a portion thereof (as depicted by the dashed lines d3) tucked under the edge "e" of segment 202, and overlie, engage and be adhered to segment 204 by the glue strip g2, thereby closing the bottom of the container. Note the small drainage openings 17 and 19 left at the corners where the segments do not overlap. At this point the container can be filled with any desired contents.

Figure 9:
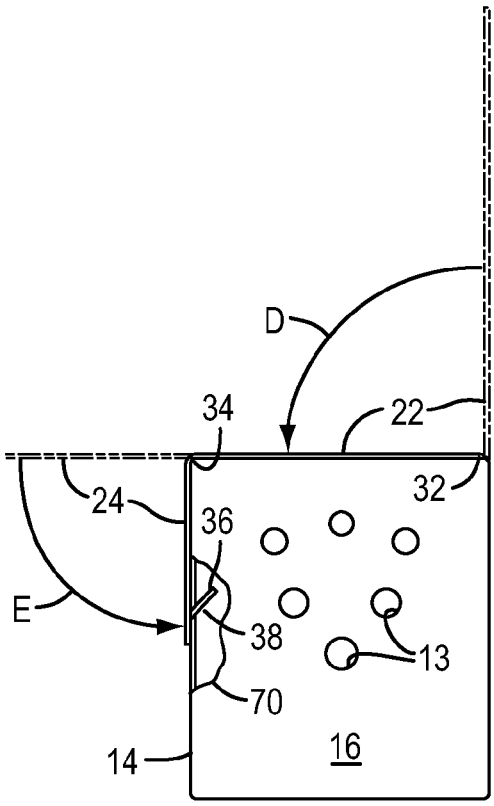
FIGS. 9 and 10 are side elevations illustrating how a closure forming portion, and associated flap and carry handle sub-portion of the blank shown in FIG. 2 are folded about fold lines to close the top of the container, secure the flap to a wall portion, and form a carry handle.

FIG. 9 is a side elevation of the container in which the top closure panel 22 and latch flap 24 are shown in their closing configurations after having been respectively, rotated about the fold lines 32 and 34 as suggested by the arrows D and E. In this depiction, side panel 16 has been partially broken away at 70 to illustrate how the flap 24 is locked in its latching position by deflecting the latch tabs 36 rearwardly and extending them through the slots 38 (FIG. 3) in the front panel 14.

Figure 10:
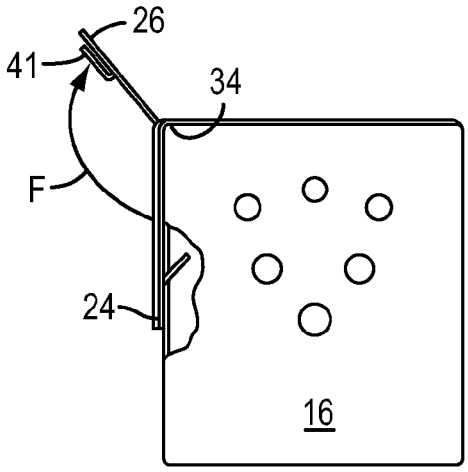

Arrow F in FIG. 10 illustrates how the handle flap 26 is rotated upwardly about fold line 34, out of alignment with latch flap 24 and into its carry position.

Figure 11:
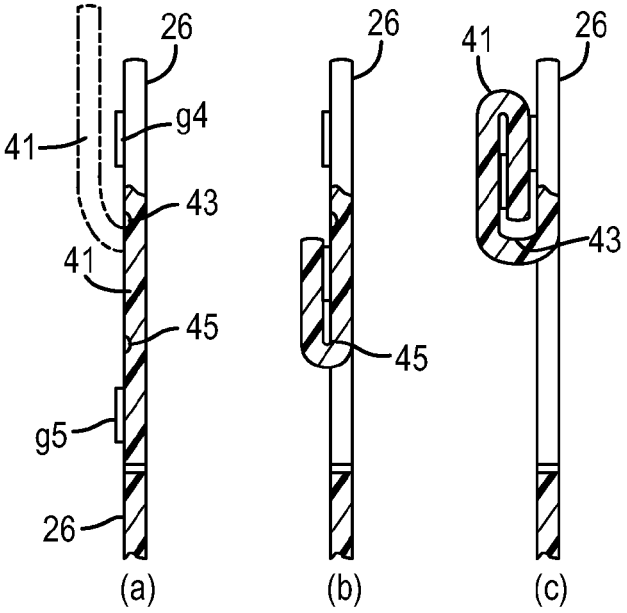
FIG. 11 is a 3-part, broken cross-sectional view progressively illustrating formation of the carry handle after it is rotated away from the flap.

FIG. 11 is a three part, broken cross-sectional view revealing how the displaceable elongated segment 41 (FIG. 2), if not removed during the die cutting operation, can be simply displaced and folded upwardly or be progressively folded to provide a protective carry surface at the upper edge of the finger slot 40 for engagement by a carrier's fingers.

Specifically, as suggested by the dashed lines in part (a) of FIG. 11, the segment 41 can simply be displaced and rotated upwardly about the fold line 43 by the user as he extends his fingers through the slot 40. Alternatively, glue strips g4 and g5 might be provided on the face of segment 41 as well as above it, such strips extending in parallel with the fold lines 43 and 45 so that the lower portion of the segment 41 can first be folded about the fold line 45 and be adhered to the upper portion thereof by the glue strip g5, as depicted in part (b) of FIG. 11, and then the folded segment can again be folded about the second fold line 43 to engage and be secured to the upper part of the handle flap by the second glue, strip g4 as illustrated in part (c). This would provide a more acceptable finger hole embodiment.

Figure 12:
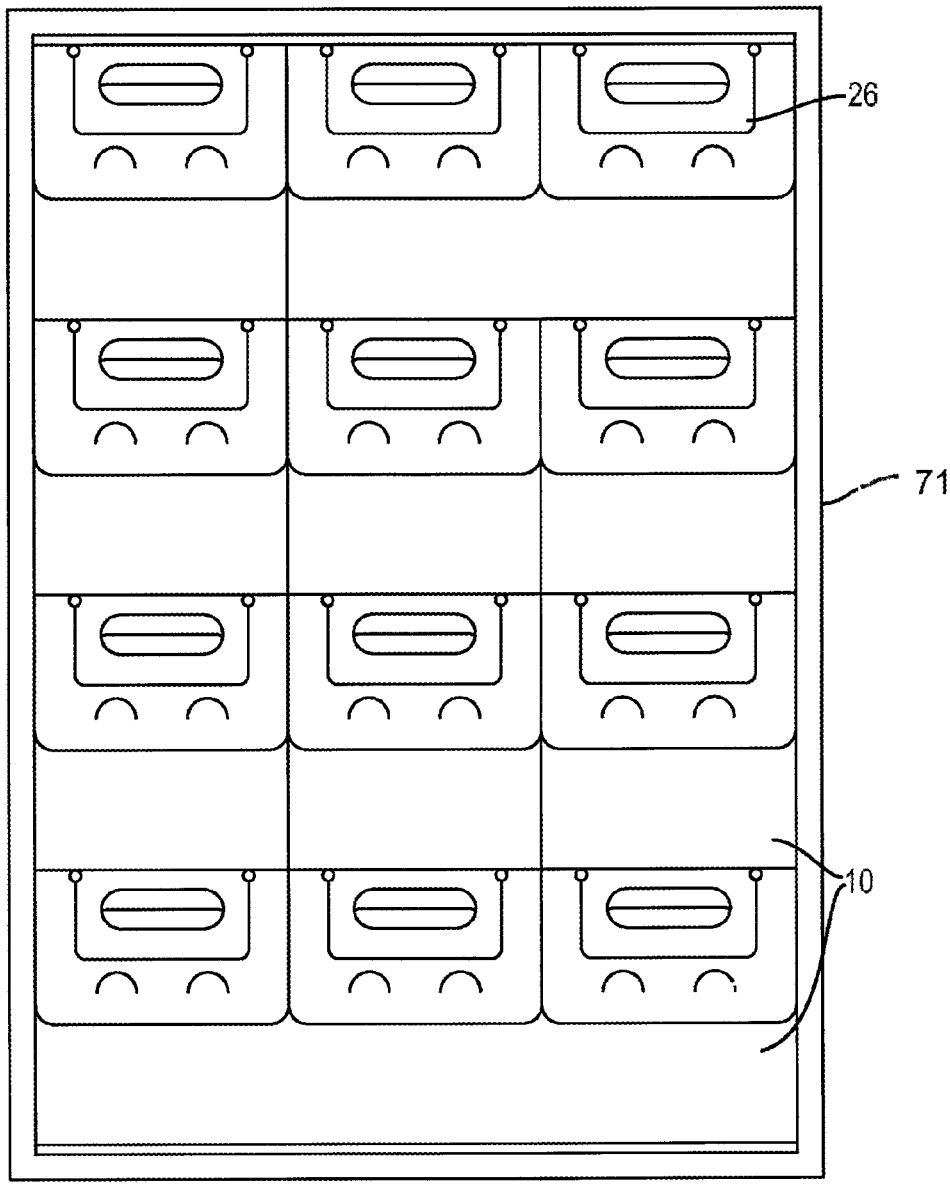
FIG. 12 is plan view showing a plurality of containers nested together in a flat for shipping, storage and/or display.

FIG. 12 shows a shipping box, or "flat", 70 sized to hold 12 containers 10 in a 3 by 4 array. A container 10 may be removed from the flat by simply rotating the corresponding handle 26 away from the container and using it to lift the package from its position within the flat.

FIG. 13 illustrates in plan view a blank 80 of a first alternative embodiment having three rectangular side wall panels 82, 84 and 86 instead of four as in the previous embodiment, a triangular top closure panel 88, three triangularly shaped bottom closure segments, 90, 92 and 94, and two latch flaps 96 and 98, the latter including an apertured handle 100. Blank 80 also includes two edge stiffening tabs 102 and 104, a fastening tab 106 having a strip of mastic provided thereon, a plurality of latch tabs 108 and a matching plurality of tab receiving slits 110. As in the first described embodiment, all of the component parts except the handle 100 are defined by dashed fold lines shown in FIG. 13.

Although not shown herein, each of the panels may include one or more openings (not shown) to provide ventilation and/or fluid flow-through/drainage to/from the interior of the container 80 as was described in the preceding embodiment. In addition, the bottom forming segments (FIG. 15) may be provided with drain openings 93. It may also be advantageous to provide a strategically positioned mastic patches 95 on one or more of the bottom closure segments 90, 92, 94 to improve the integrity of the assembled container bottom.

By folding the blank 80 along the fold lines 112 and 114, affixing the leftmost edge 116 to the right-side boundary 118 of panel 86 using the fastening tab 106, folding the segments 90, 92, 94 along fold line 120 and interleaving them as depicted in FIG. 14 to form a bottom closure, folding the top closure panel 88 along fold line 122 and latch tabs 96 and 98 along the fold lines 124 and 126 respectively, and then folding handle 100 upwards along fold line 126, the container illustrated in FIG. 15 is assembled and completed by inserting the tabs 108 into the slots 110 on side panels 82 and 84.

As in the first embodiment described above, by folding the segment 128 upwardly, a finger receiving opening 130 may be provided allowing the container to be carried in the same manner described above.

Figure 16:
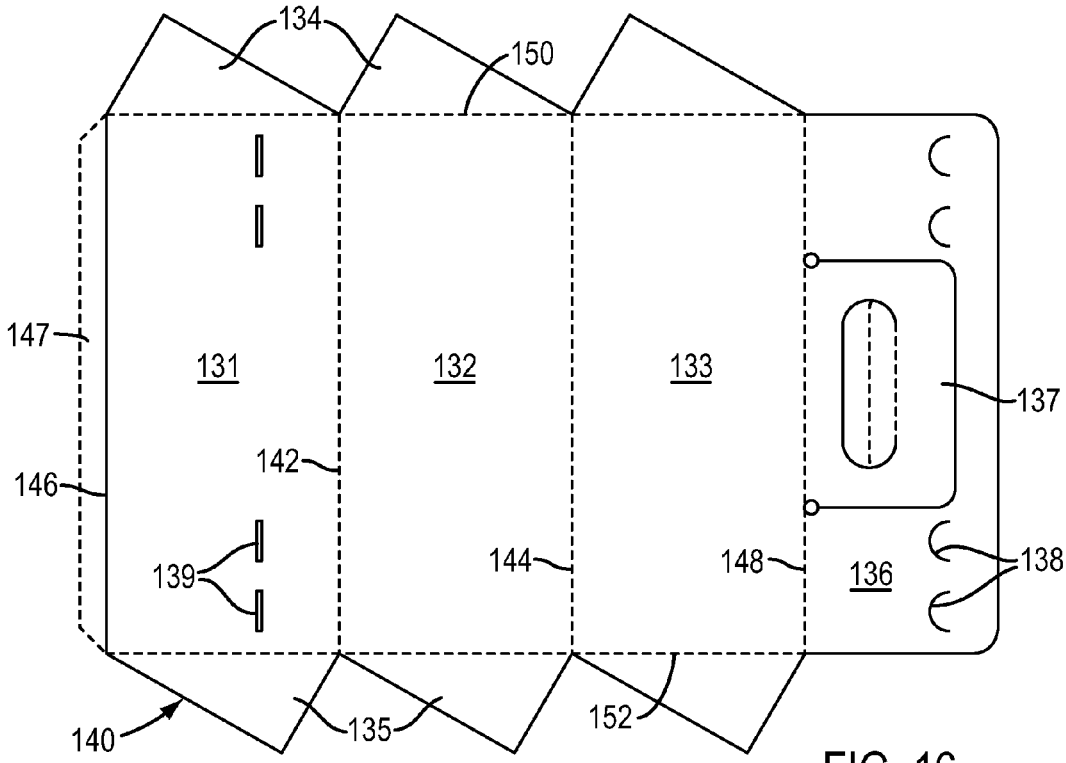
FIGS. 16 and 17 illustrate a second alternative embodiment of a container in accordance with the present invention.
Figure 17:
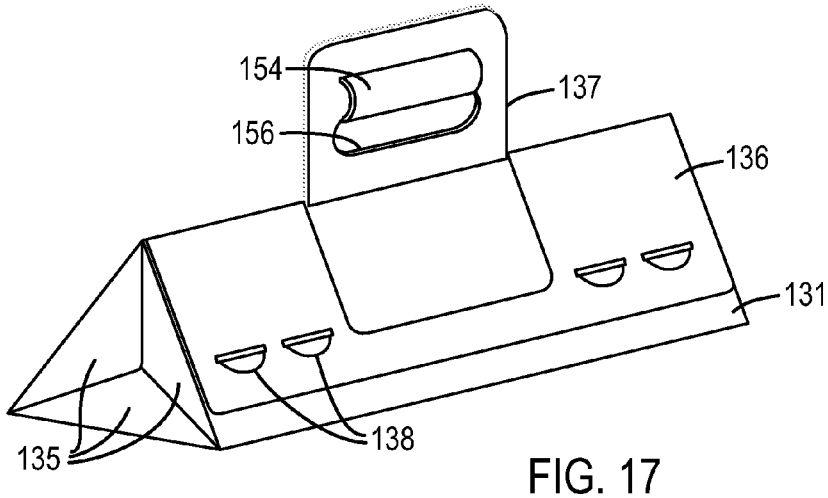

Another alternative container embodiment is depicted in FIGS. 16 and 17 that might be suitable for packaging elongated produce such as celery, asparagus and the like, or generally spherically configured fruits such as cherries, strawberries, tomatoes, plums, etc.

More particularly, a blank 140 is depicted in plan view in FIG. 16 adapted to form three rectangular wall panels 131, 132 and 133, two sets of three triangularly shaped end closure segments 134 and 135, and a latch flap 136 including an apertured handle 137. Blank 140 also includes a plurality of latch tabs 138 formed in the flap 136 and a matching plurality of tab receiving slits 139 formed in panel 131, and may include a stiffening edge tab 147 which may also be provided with a mastic strip or patches as described in the preceding embodiments to affix panel edge 146 to panel 133 at the fold line 148. As in the previously described embodiments, most of the component parts are defined by fold lines shown as dashed lines in FIG. 16.

By first folding the blank 140 along the fold lines 142 and 144, positioning the leftmost edge 146 of panel 131 contiguous to the fold line 148 which forms the right-side boundary of panel 133, then folding the latch flap 136 along the fold line 148 and then inserting the latch tabs 138 into the slots 139, assembly of the container is completed by respectively folding the segments 134 and 135 along fold lines 150 and 152 and interleaving them as depicted in FIG. 14 to form end closures. In this embodiment one end would serve as the fill opening before being closed by interleaving the several segments. Alternatively, the segments at one or both ends can be eliminated and a triangular shaped end cap (not shown) substituted therefor.

As in the embodiments described above, by folding the handle 137 upwardly and rotating the segment 154 out of the finger receiving opening 156, the container may be carried in the same manner described above.

Although not shown in the above alternative embodiments, strategically disposed openings may be provided in any or all of the container forming components or segments to facilitate washing and/or ventilation of the contents as described above.

Still another alternative embodiment is illustrated in FIGS. 18-20 which is similar in appearance and function to the first described embodiment except that in this example, instead of the handle portion 160 of the die cut blank being formed by a severed portion of the latch flap 162, it is embodied as an appendage of the front wall panel 164. As further illustrated in FIG. 18, the die cut blank 161 also includes an elongated slot 166 extending along the fold line 168 and adapted to receive the handle 160 as the top closure 163 is rotated about the fold line 170 to close the container, as is progressively illustrated in FIGS. 19 and 20. The flap 162 is then secured to the front wall panel 164 by rotating the latch flap 162 downwardly about the fold line 168 and inserting the tabs 172 into the slots 174. As thus configured, the container of FIGS. 18-20 would appear to be substantially identical to that shown in FIG. 1.

Figure 21:
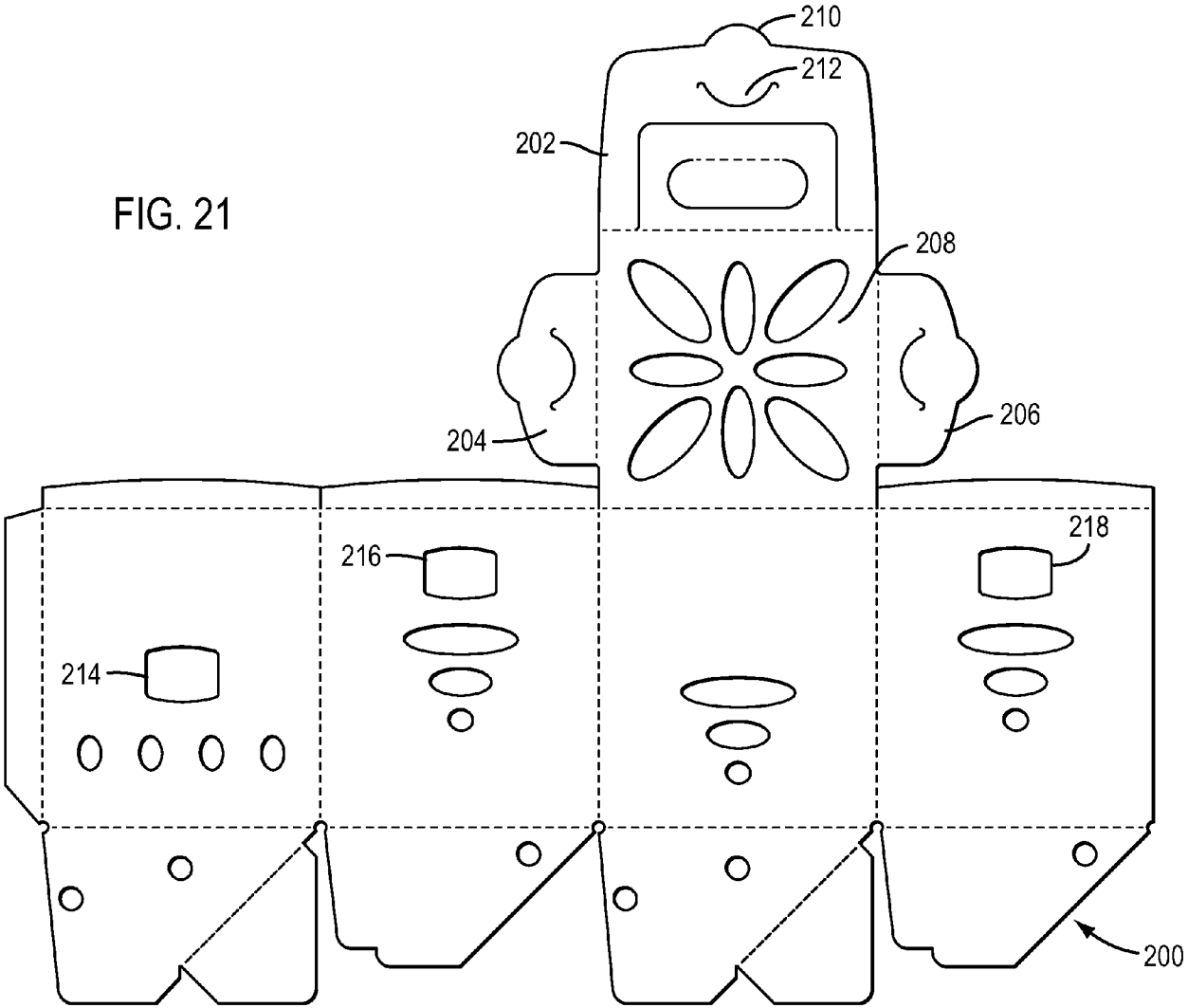

A further alternative embodiment is illustrated in FIGS. 21-25 which is similar in appearance and function to the above described embodiments except that in this example, the die cut blank 200 is again modified to have an alternative latching configuration. More specifically, in this embodiment, three latching flaps 202, 204 and 206 are provided with each extending from one of the side edges of the top forming panel 208 as illustrated in FIG. 21.

As illustrated, each of the flaps includes a pair of crescent shaped latching tabs 210 and 212 facing in opposite directions. These tabs are designed to be bowed towards each other and then inserted into a generally rectangular shaped opening of the type depicted at 214, 216 and 218 once the blank is folded and secured to form the produce container. This configuration of latch flaps and receiving opening has been found to exhibit improved fastening reliability because the dual flap configuration is less likely to be dislodged from its keeper engagement in the event of a container deforming event. Furthermore, since the flaps are configured to have a back-to-back engagement relationship with the keeper opening, they also resist shearing displace of the flaps relative to the container walls and as a consequence result in a more rigid container structure.

Figure 22:
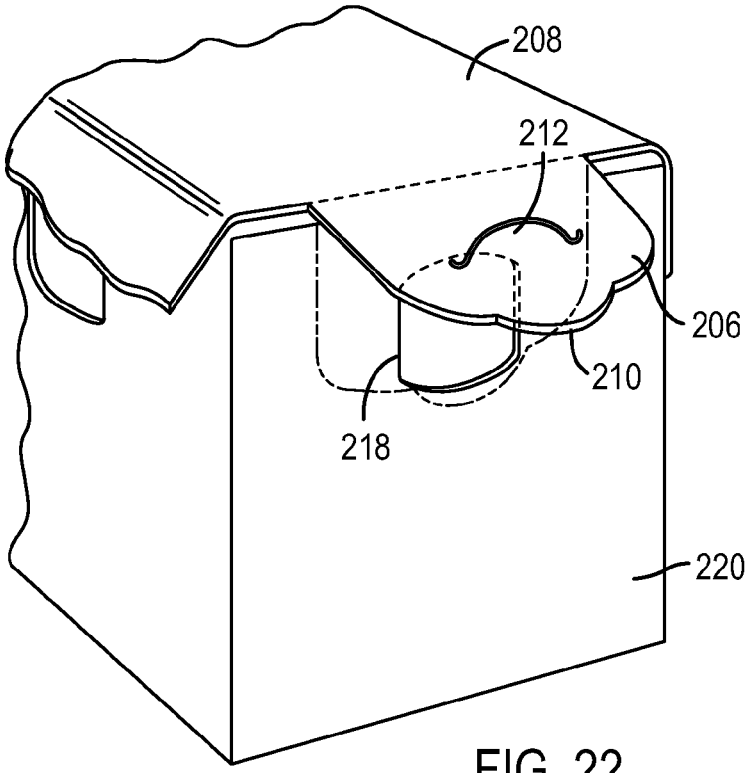
Figure 23:
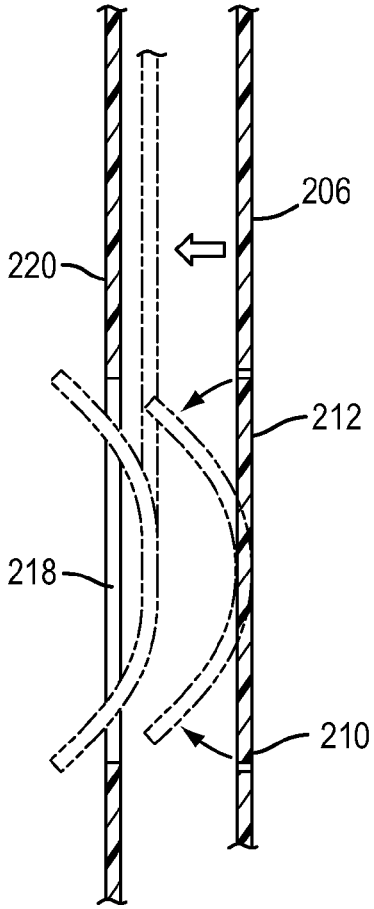

The latching operation is illustrated in FIGS. 22 and 23. As depicted in FIG. 22, as the top panel 208 is rotated into its closing position, the three flaps 202, 204 and 206 will extend over the container side panels and each will be in alignment with one of the keeper openings 214, 216 and 218. As each flap is rotated downwardly the tabs can be made ready for entering the keeper openings by squeezing them together as illustrated in FIG. 23 for example. By so deforming the tabs 210 and 212, the vertical span of the tab unit will be reduced such that it can easily enter the keeper opening 218, and upon being released, its natural resiliency will cause the tabs to attempt to return to their coplanar disposition with the result being that they interfere with the opening perimeter and retain the flap in its latched configuration. Although a single flap so configured will no doubt be adequate for some applications, the three flap configuration is deemed to be preferable.

Figure 24:
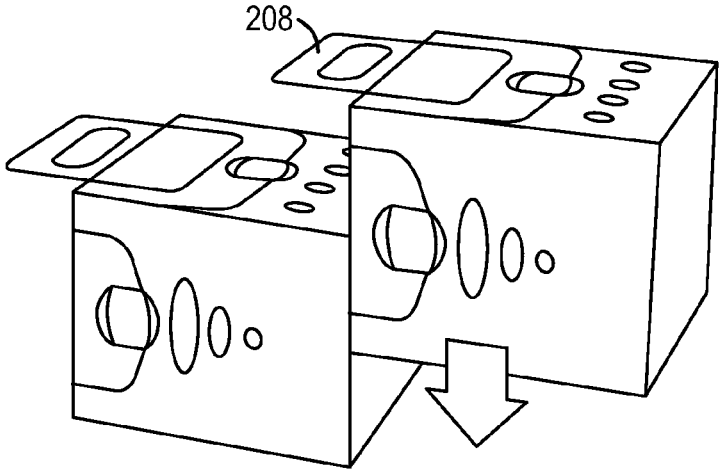
Figure 25:
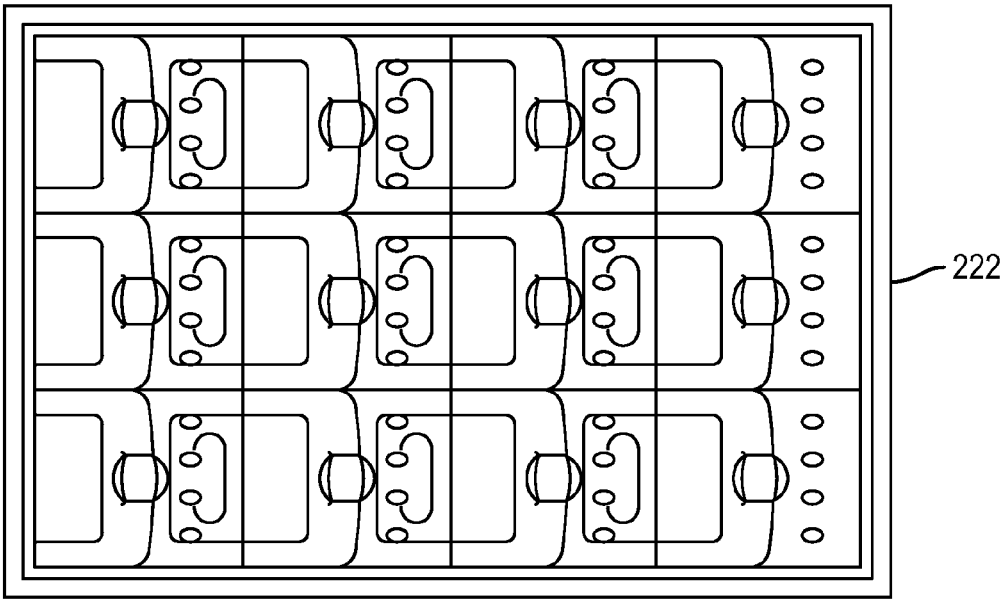

Another feature of this embodiment is depicted in FIGS. 24 and 25; namely, that with the container flaps in their latched configurations and the handle flap extending upwardly, the container can be rotated onto its front face as illustrated and slid into a storage position in a shipping flat 222 as depicted in FIG. 25. Note that in this configuration a plurality of the containers can be compactly stored in the flat, but can be easily extracted therefrom because the handle flap is overlaying the adjacent container and is thus readily accessible.

Although the present invention has been described and illustrated above in terms of three specific embodiments, is envisioned that other variations, modifications and embodiments will become apparent to those skilled in the art after having read this disclosure. For example, it is anticipated that one might want to eliminate the integral handle and affix a separate part to the container, or alternatively, provide no handle at all where the container is small and can be conveniently held without a handle.

Accordingly, it is intended that the above described embodiments be considered merely illustrative of the invention and not limiting, and that the appended claims be interpreted as covering all such variations, modifications and embodiments as fall within the true spirit and scope of the invention.

The invention claimed is:

1. A packaging container made from a blank cut from sheet material and comprising:

an elongated portion of said blank being folded along a plurality of first fold lines to form a plurality of container walls;

closure forming portions of said blank extending from said elongated portion and folded about a plurality of second fold lines to cooperate with the container walls to define a predetermined volume of space, said closure forming portions having apertures formed therein for allowing fluid to flow through the container;

at least one other portion of said blank being folded about a third fold line to form a flap having securing means for securing at least one of said closure forming portions or said container walls to at least one of said container walls, wherein at least one of said closure forming portions includes a to forming portion of said blank disposed between one of said plurality of second fold lines and said third fold line, and wherein said top forming portion is securable in its container closing position by said flap; and a handle forming portion of said blank cut from a subportion of said flap and extending from said third fold line to form a carry handle for the container.

2. A packaging container as recited in claim 1 wherein said first fold lines extend substantially transverse to the length of said elongated portion to define four contiguous container walls.

3. A packaging container as recited in claim 1 and further comprising an attachment means affixed to one end of said elongated portion to affix said one end to the opposite end of said elongated portion.

4. A packaging container as recited in claim 3 wherein said attachment means includes an integrally formed tab having an adhesive suitable for bonding said one end to said opposite end.

5. A packaging container as recited in claim 1 wherein said container walls have apertures formed therein for ventilating the interior of said container.

6. A packaging container as recited in claim 1 wherein at least some of said closure forming portions include segments of said blank, each of which is contiguous with one of said container walls and adapted to be interleaved with other segments to form a closure.

7. A packaging container as recited in claim 1 wherein said blank further comprises at least one other portion foldable about a fourth fold line extending to intersect said second and third fold lines to form another flap, wherein said another flap also includes securing means for additionally securing said at least one closure forming portion to one of said container walls.

8. A packaging container as recited in claim 7 wherein at least one of said container walls includes an opening for interlockingly receiving a distal portion of one of said flaps to form said securing means.

9. A packaging container as recited in claim 1 wherein at least one of said container walls includes at least one slit formed therein, and wherein said securing means includes at least one tab formed on said flap and adapted to be inserted into said slit to retain said flap in its closure securing disposition.

10. A packaging container as recited in claim 6 wherein said segments are configured such that when interleaved to form a closure, drain openings are left at each corner of the closure thus formed.

11. A packaging container as recited in claim 1 wherein said handle forming portion includes a finger receiving aperture formed therein.

12. A packaging container as recited in claim 11 wherein said handle forming portion also includes a segment of said blank displaceable about a segment fold line to form said finger receiving aperture.

13. A packaging container as recited in claim 12 wherein said displaceable segment is foldable to form a gripping surface at said segment fold line.

* * * * *